US005779245A

United States Patent [19]

Smith et al.

[11] Patent Number: 5,779,245

[45] Date of Patent: Jul. 14, 1998

[54] ROLLER SKATE LOCK

[76] Inventors: Lyndon Smith, 32 Lankin Blvd., Orillia, Ontario, Canada, L3V 6T2; Charles Johnson, 101 Front Street South, Orillia, Ontario, Canada, L3V 4S5; Sean Finucan, 142 Mississaga Street, Apt. 3, Orillia, Ontario, Canada, L3V 3B2

[21] Appl. No.: 662,973

[22] Filed: Jun. 13, 1996

[51] Int. Cl.[6] ..... A63C 17/14

[52] U.S. Cl. ..... 280/11.2; 188/265; 280/809

[58] Field of Search ..... 280/11.22, 11.2, 280/809; 188/265

[56] References Cited

U.S. PATENT DOCUMENTS

| | | | |
|---|---|---|---|
| Re. 32,346 | 2/1987 | Klamer et al. | 280/11.2 |
| 3,871,672 | 3/1975 | Bardy . | |
| 4,928,982 | 5/1990 | Logan . | |
| 5,143,387 | 9/1992 | Colla | 280/11.2 |
| 5,192,099 | 3/1993 | Riutta | 280/11.2 |
| 5,232,231 | 8/1993 | Carlsmith | 280/11.2 |
| 5,236,224 | 8/1993 | Anderson et al. | 280/11.22 |
| 5,239,941 | 8/1993 | Chibi | 280/11.2 |
| 5,351,974 | 10/1994 | Cech | 280/11.2 |
| 5,375,859 | 12/1994 | Peck et al. | 280/11.2 |
| 5,403,021 | 4/1995 | Scifrin | 280/11.2 |
| 5,511,805 | 4/1996 | McGrath | 280/11.2 |
| 5,630,597 | 5/1997 | Klukos | 188/74 |
| 5,657,999 | 8/1997 | Beaulieu | 280/11.2 |
| 5,704,618 | 1/1998 | Sfoggia | 280/11.2 |

FOREIGN PATENT DOCUMENTS

| | | | |
|---|---|---|---|
| 77029959 | 4/1979 | Australia | 280/11.2 |
| 2139777 | 11/1994 | Canada . | |
| 2116091 | 8/1995 | Canada . | |
| 545250 | 6/1993 | European Pat. Off. | 280/11.2 |
| 143245 | 11/1902 | Germany | 280/11.2 |

*Primary Examiner*—Thomas J. Brahan
*Attorney, Agent, or Firm*—Paul S. Sharpe; Marks & Clerk

[57] ABSTRACT

A lock system is disclosed for use on an in-line roller skate to positively lock the wheels. The lock system includes a mounting member for mounting the lock to the chassis of a roller skate. The mounting member includes a movable abutment member having a plurality of abutments for selective engagement with the wheels. Hub projections are provided on the wheels for engagement with the abutment member. In another embodiment, the abutment member may comprise a plurality of spaced apart stops for interstitial between wheels to be locked. The arrangements have marked advantages over the existing systems in that the same are readily engagable with a minimum of effort. In this manner, the user can simply engage and disengage the lock device without any encumbrances typically associated with the prior art.

6 Claims, 6 Drawing Sheets

ROLLER SKATE LOCK

FIELD OF THE INVENTION

The present invention is directed to a roller skate lock and more particularly, the present invention is directed to a selectively operable locking system to lock the wheels of a roller skate against rotation so that a user can walk about freely with the roller skate on his or her foot.

BACKGROUND OF THE INVENTION

With the advent of in-line roller skates and their significant popularity, there have been many arrangements proposed in the art for braking and for locking the wheels. It is desirable to have the wheels quickly lockable so that a user can readily climb stairs which would otherwise be difficult with a rolling surface such as that presented on a roller skate or when the user is entering areas where skating is prohibited.

Of the arrangements that have been proposed in the art, an example is set forth in Canadian laid-open Application No. 2,116,091 where the Applicant has provided a wheel lock which is simply directed to a bent wire. The wire is configured such that it engages the wheels so that they do not rotate. The system is simply based on a tension principle for pressure contact with the wheels and comprises a loose piece which can be readily put on and taken off by the user. Although this arrangement appears to have some utility, it is clear that it is extremely dangerous to have a loose element which, due to the fact that the same is simple spring steel could, over time, become ineffective and present a dangerous situation to the user. As a further disadvantage, this arrangement requires the user to carry the lock around on his or her person and would appear to require a certain degree of manipulation in order to position the device on the wheels.

A further arrangement which is known in the art is that taught in Canadian Application No. 2,139,777 filed May 9, 1994 by Johann Perner. In the system disclosed, the arrangement involves an axle which is insertable within aligned openings in a frame on the skate, which frame permits the axle to be passed through to the other side of the wheel. The axle is engagable with a locking member in the form of a hook. The hook appears to be freely swingable on an axis and it would appear to be susceptible to disengagement from the axle when subjected to shock stress such as that which would be experienced when the user is on stairs, etc. In addition, this system would appear to require significant modifications to not only the wheel, but the chassis; such modification would quickly accelerate the cost of the arrangement and encumber the possibility of the arrangement being easily retrofit to existing skates.

U.S. Pat. No. 3,871,672, issued Mar. 18, 1975 to Bardy, teaches a walking roller skate device where the arrangement essentially provides a selectively actuable arrangement to ensure that the wheels are only forwardly rotatable.

In view of what the prior art has proposed, it would be desirable to have a locking system which is quickly and easily employable and further which does not involve significant modification of the existing roller skate wheel chassis or other related components.

SUMMARY OF THE INVENTION

One object of the present invention is to provide an improved locking system for use on a roller skate.

A further object of one embodiment of the present system is to provide a locking system for locking roller skate wheels against rotation, comprising:

movable abutment means for selectively contacting the wheels for preventing rotation thereof, the abutment means being movable from a storage position out of contact with the wheels to permit full rotation of the wheels to a use position where the abutment means contact the wheels to prevent rotation; and abutment mounting means for movably mounting the abutment means, the abutment mounting means adapted for mounting to a roller skate.

The arrangement is typically applicable to single track or in-line roller skate systems.

It has been found that the use of abutment members can readily function to prevent unwanted rotation of the wheels when the user engages the abutment members. In one embodiment, the locking system may include a single abutment member which would be useful for some types of in-line skates, typically those with three wheels. Such an arrangement would be adequate for walking on flat or relatively flat surfaces. In the instance where the user wishes to walk on stairs, several abutments may be employed to prevent rotation of all of the wheels as opposed to a selected set.

In one embodiment, the abutments may comprise simple stops composed of a suitable material, e.g. the material of which the wheels are made or any suitable high friction material. In one embodiment, the abutments may be slidably movable from a use position to a position where they are engaged between the wheels and more specifically the interstitial spaces between the wheels. The abutments may be attached to a common holder member and moved downwardly into position or slid into position.

In the embodiment when the abutments are interstitially positioned, as wheel wear occurs, the interstitial abutments will simply conform to the reduced diameter of the wheels. The abutment need not be solid, but rather may simply be hollow, generally triangular members; this feature reduces the overall mass of the arrangement which is particularly desirable for the user. In another embodiment, the same may be simply pivoted from a non-use position to a locking position.

Yet another object of the present invention is to provide a roller skate having lockable wheels comprising, in combination:

a roller skate having a plurality of wheels and a chassis for supporting the wheels;

a releasable locking system for locking the wheels against rotation, the locking system including movable abutment means for selectively contacting the wheels and for preventing rotation thereof, the abutment means being movable from a storage means out of contact with the wheels to permit full rotation of the wheels to a use position where the abutment means contact the wheels to prevent rotation; and mounting means for mounting the abutment means to the chassis.

Advantageously, the locking system according to one embodiment of the present invention may be easily retrofit to existing in-line skates. This is a marked advantage over the systems which are presently known in the art which otherwise require significant manipulation and/or modification of the wheels or chassis or both in order to fit the apparatus onto the skate. Accordingly, the present invention can be easily retrofit to any form of existing skate.

A further object of the present invention is to provide a locking roller skate comprising:

a roller skate having a plurality of wheels and a chassis for supporting the wheels, the wheels including a projection having at least three sides;

a selectively engagable and releasable locking system for locking the wheels against rotation, the locking system including a slidable abutment member having a plurality of abutments and recesses in alternation, the recesses configured to receive the projections in a locked position; and means for slidably mounting the abutment member to the chassis.

As a further embodiment of the present invention, the lock system may comprise a cam system. As an example, a series of abutments on a common holder may include a generally wedged shaped cam surface on the holder configured to cooperate with a slidable separate cam for urging the abutments into and out of interstitial contact with the wheels.

By making use of the present invention, the user can be assured that the device is positively engaged by the actuation means. Conveniently, the actuation means includes a friction screw to positively locate the abutment member in contact with the wheels. A particularly desirable advantage of the system disclosed herein can be realized in that the arrangement is not cumbersome to operate. A simple movement of the abutment member effects the locking and the same can be positively locked with the actuation means. This is in contrast to existing systems which are cumbersome to operate and are potentially susceptible to failure.

Having thus described the invention, reference will now be made to the accompanying drawings illustrating preferred embodiments.

BRIEF DESCRIPTION OF THE DRAWINGS

Similar numerals in the drawings denote similar elements.

DETAILED DESCRIPTION OF THE PREFERRED EMBODIMENTS

Figure 1:
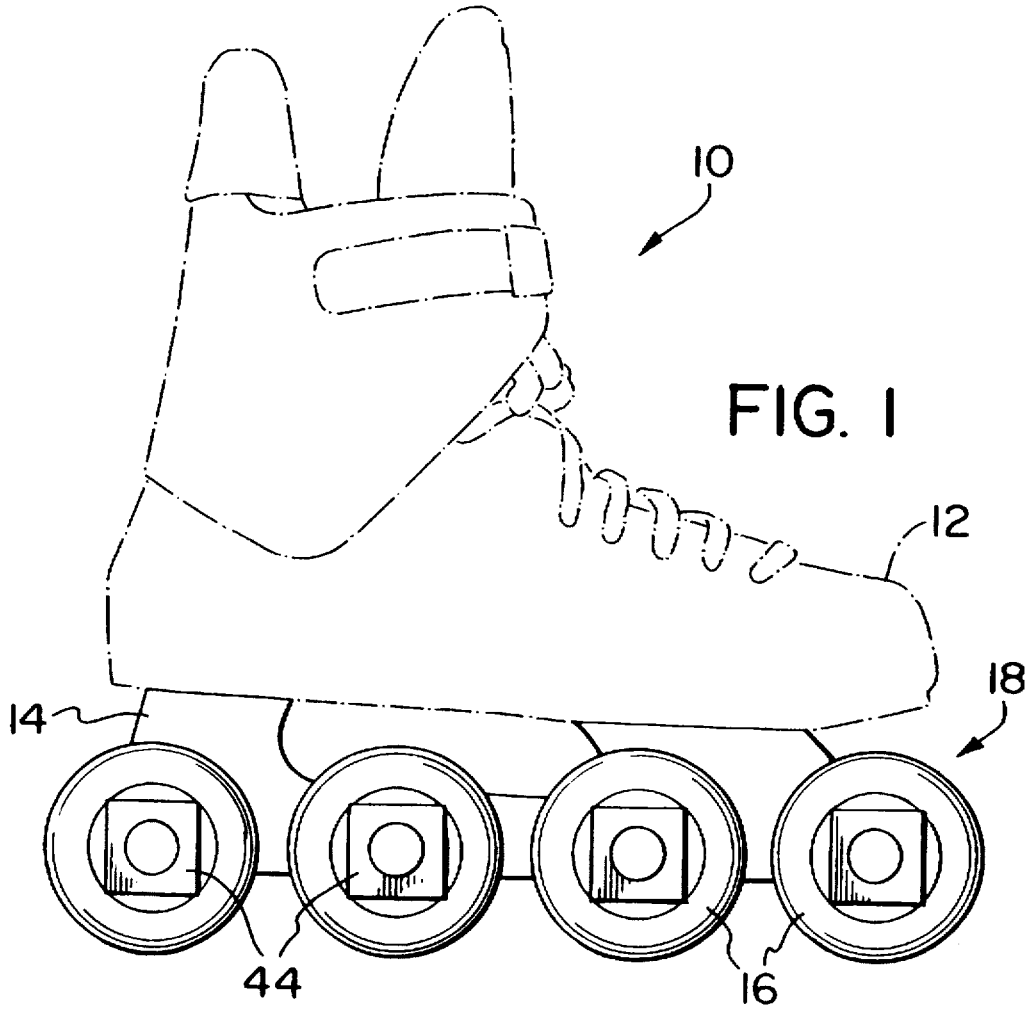
FIG. 1 is a side view of a skate with the locking mechanism according to one embodiment of the invention.
Figure 2:
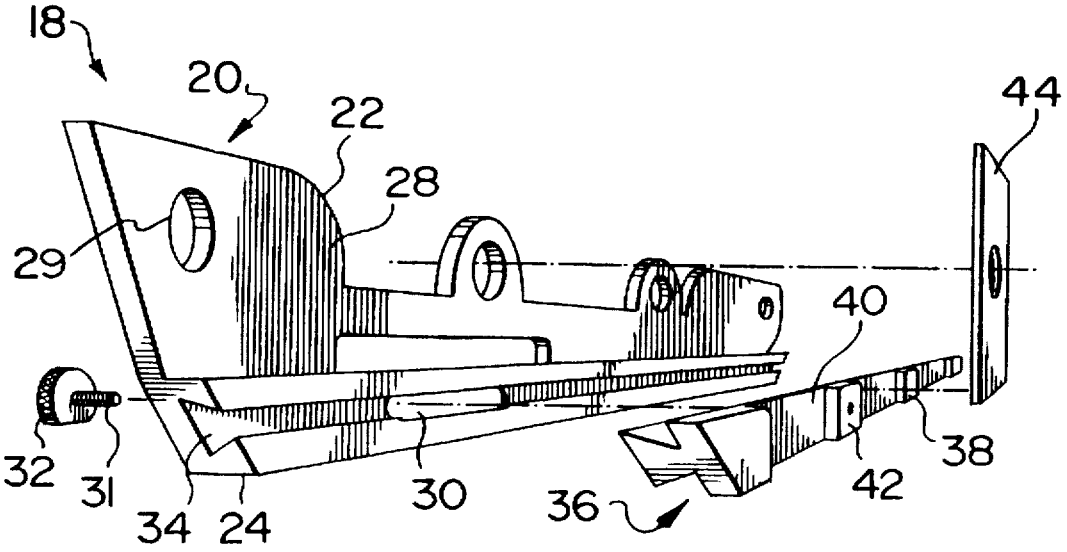
FIG. 2 is an exploded view of the mounting member of the locking arrangement.

Referring now to the drawings, FIG. 1 illustrates a typical roller skate boot, globally denoted by numeral 10, the skate including a boot portion 12, a wheel chassis 14 and a plurality of wheels 16. The locking arrangement for locking the wheels 16, shown in FIG. 2, is broadly denoted by numeral 18 and is for locking the wheels of the skate to be discussed hereinafter.

Figure 3:
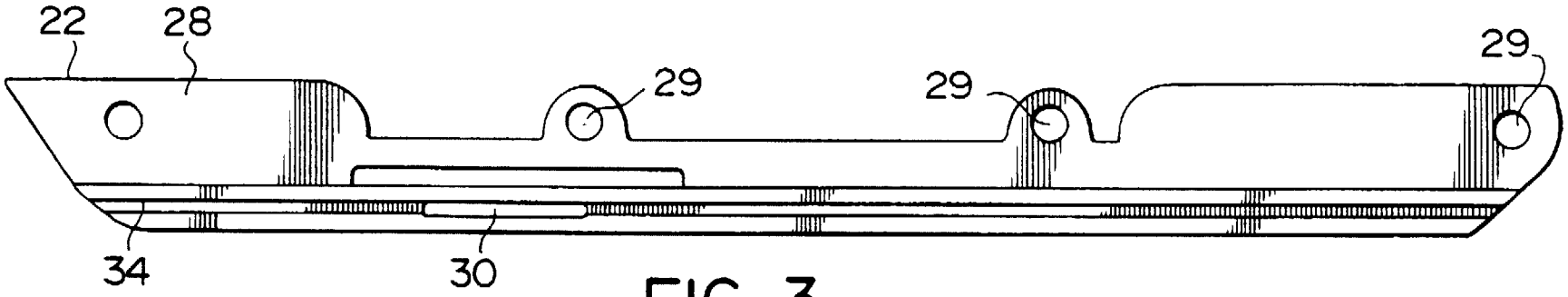
FIG. 3 is a side view of the abutment member mounting according to one embodiment.
Figure 4:
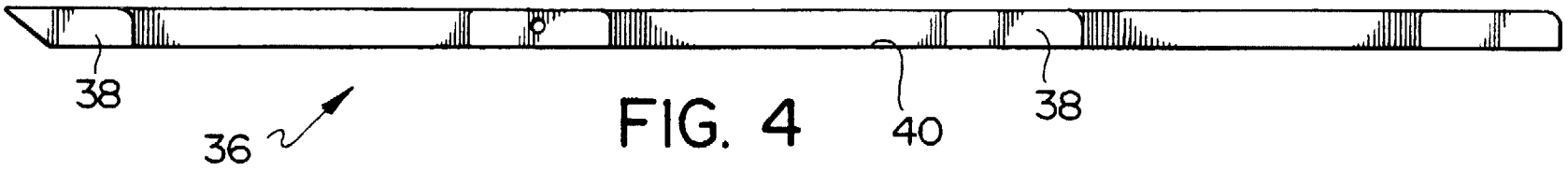
FIG. 4 is a top plan view of the abutment member.

The locking arrangement 18 includes a first mounting member 20 having a top edge 22 and a bottom edge 24 as well as an outside surface 26 and an inside surface 28. Proximate top surface 22, there is provided a plurality of apertures 29, which receive the axle (not shown) of each wheel 16 as illustrated in FIG. 1. The arrangement, shown in FIGS. 2, 3 and 4, additionally includes a slot 30 for receiving a threaded member 31 connected to knob 32. Knob 32 and the threaded member 31 comprise a friction screw, which screw is sidably movable within slot 30. The reverse side of the mounting member 20, and more specifically side 28, includes a channel 34, which channel 34 communicates with slot 30 as illustrated. The channel 34 has a dove tailed cross-section and slidably receives an abutment member 36 as illustrated in FIG. 3. Abutment member 36 has a dove tail cross-section for slidable reception within mounting member 20. Abutment member 36 has a series of stops or abutments 38 which are in alternation with recesses 40. Abutment member 36 includes a threaded opening 42, which opening is for receiving the threaded member on friction screw 32.

As illustrated in FIG. 1, the wheels 16 each include projecting hub members 44. In the example, the hubs are of a generally square configuration, however, it will be readily appreciated that this is exemplary only. In a preferred form, the projections 44 may comprise any suitable shape which has three or more sides. To this end, the triple or multiple sided projection 44 can be positively abutted by abutments 38 on abutment member 36 when in engaged therewith.

Figure 5:
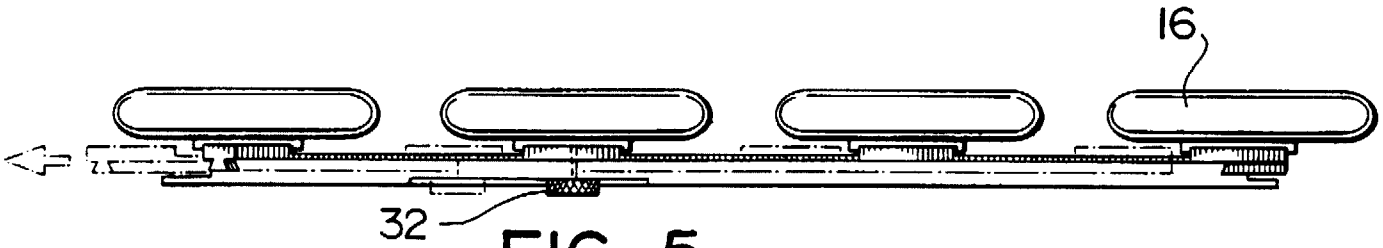
FIG. 5 is a top view illustrating the lock arrangement in a use and storage.
Figure 6:
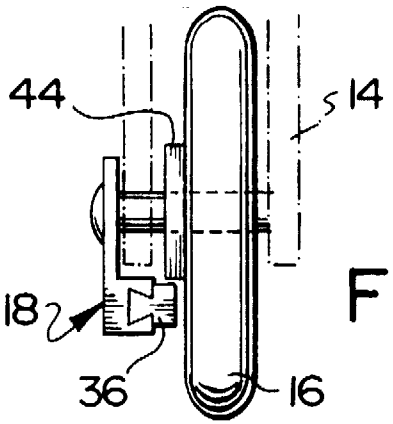
FIG. 6 is an end view of the arrangement shown in FIG. 5.

In the embodiment illustrated in FIGS. 1 through 3, reference will be made additionally to FIGS. 5 and 6. In use, the user simply unscrews knob 32 which releases the tension between mounting member 20 and abutment member 36. The knob 32 can then be axially moved either forwardly or in a reverse manner to lock or unlock, respectively, wheels 16 and more specifically the hubs 44 against abutments 38. The storage and lock positions are shown in FIG. 5, the lock position being shown in chain line where the abutments contact the hubs 44 of the wheels 16. Regardless of the position of hubs 44, the movement of the abutment member will align the hubs 44 into position for locking. In this manner, the system is self-aligning.

As an alternate system, the mounting member 20 may be eliminated if the lock is integrated at the point of manufacture of the skate. As such, a channel (not shown) may be molded into the chassis to accommodate abutment member 36.

Figure 7:
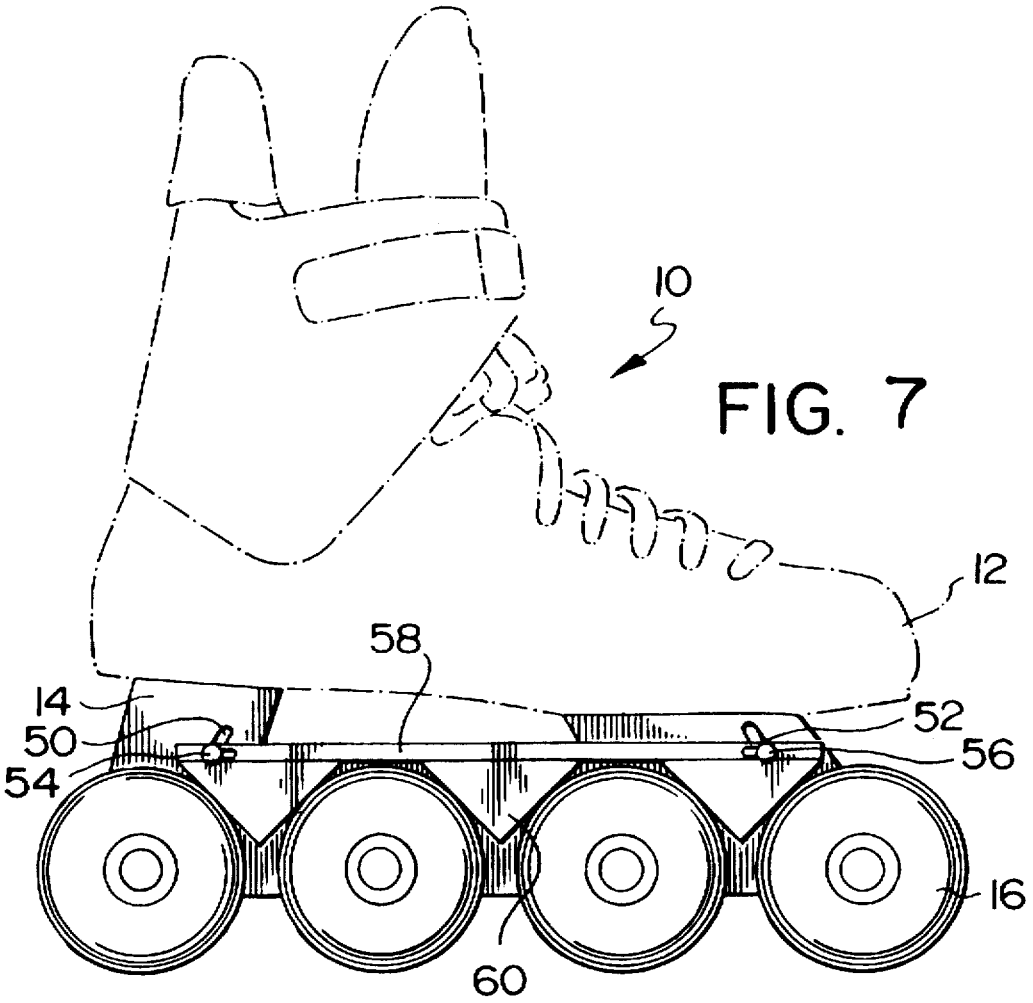
FIG. 7 is a side view of the skate with the locking mechanism according to an alternate embodiment.
Figure 8:
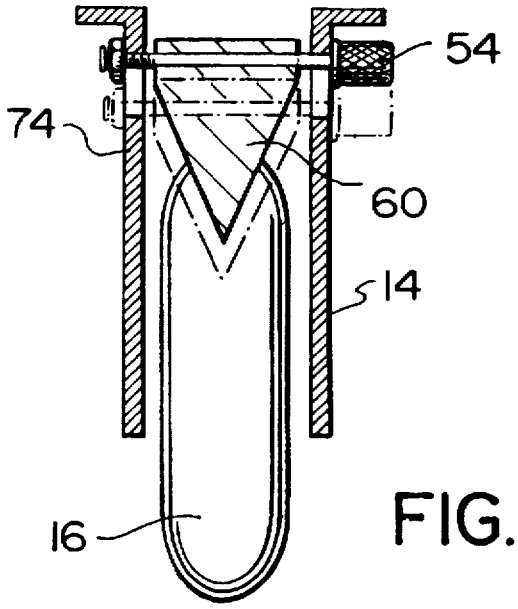
FIG. 8 is an end elevational view of the embodiment of FIG. 7.

Turning to FIG. 7, shown is an alternate embodiment of the present invention. In the embodiment shown, the wheel chassis 14 includes a pair of spaced apart slots on both sides thereof, with only one side being illustrated in FIG. 7, the slots being denoted by numerals 50 and 52. Friction screws 54 and 56 extend outwardly from the slots 50 and 52, respectively. Screws 54 and 56 are guided within the respective slot 50 and 52 such that no disengagement therefrom is possible. The screws 54 and 56 are connected to an abutment member 58, which abutment member includes a plurality of stops or abutments 60, which abutments are adapted for movement within the interstitial spaces between the wheels as shown in FIGS. 7 and 8 and as would be positioned for a locked position where the wheels do not rotate. The abutment member 58 may be fixedly secured in position in much the same manner as the friction screw discussed herein previously with respect to FIG. 2. In this manner, each abutment 60 is movable vertically in a perpendicular plane relative to the axis of rotation of the wheels 16. The storage position for the abutments is shown in FIG. 8 in an end elevation view with the use position being shown in chain line.

According to a further embodiment, the abutment member 58 as illustrated in FIG. 7, may be positioned such that it is laterally pivoted from a storage position to a use position where the abutments are interstitially engaged between the wheels to prevent rotation thereof.

Figure 9:
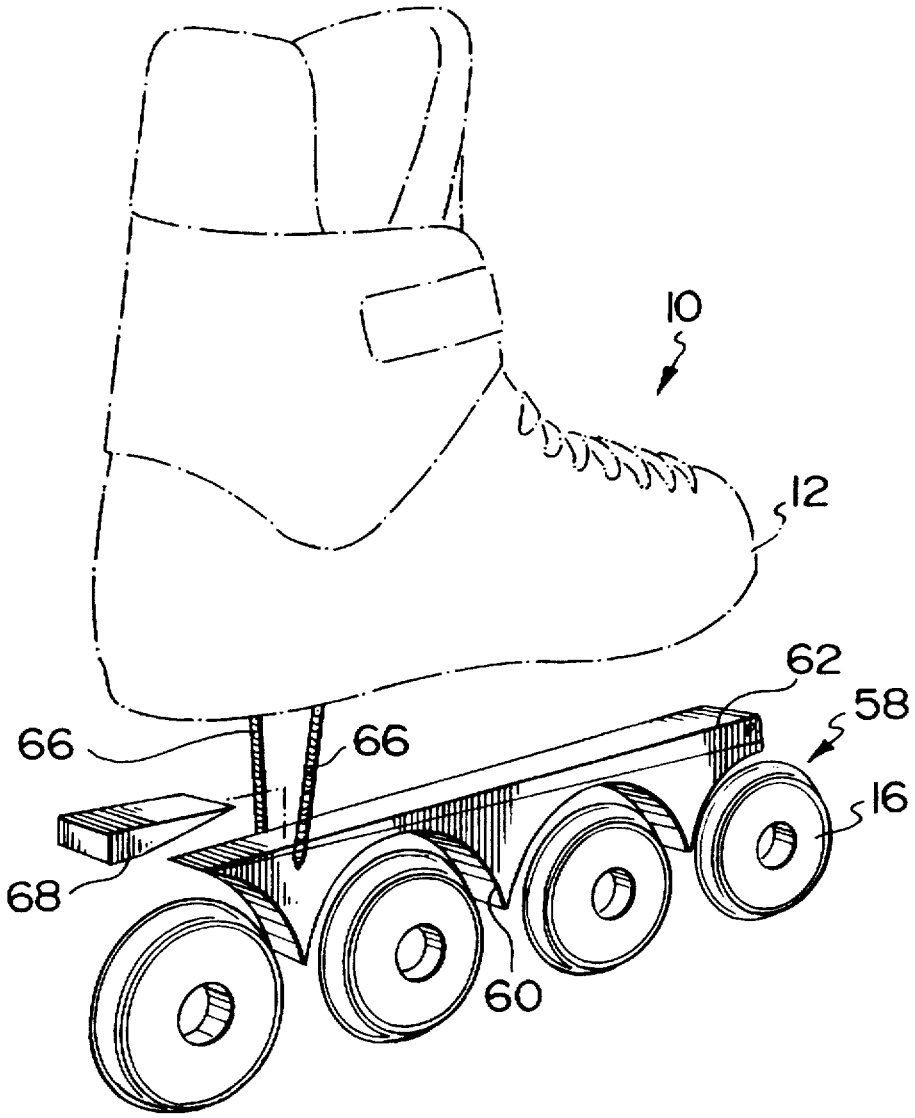
FIG. 9 is a perspective view of a further embodiment of the present invention.
Figure 10:
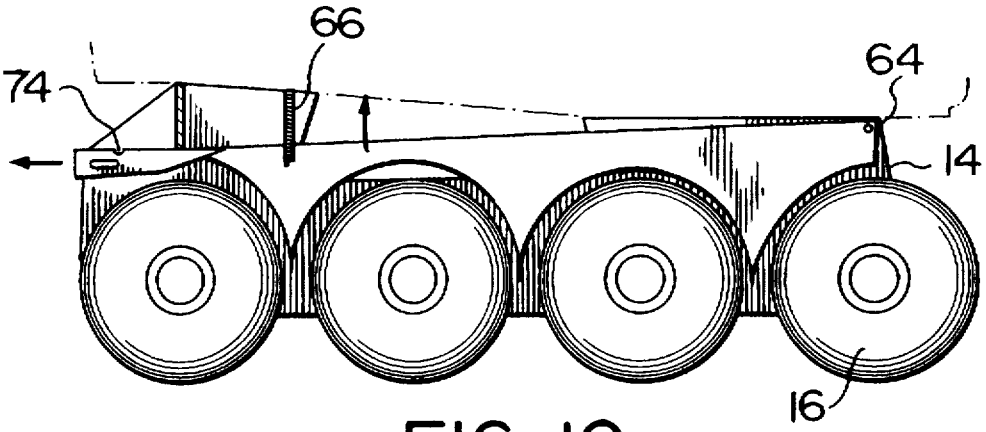
FIG. 10 is a side view of the embodiment of FIG. 9 in a storage position.
Figure 11:
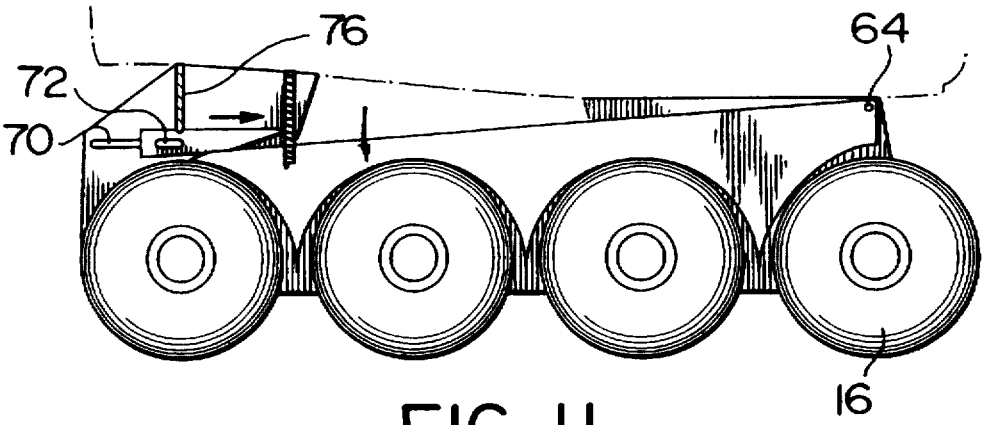
FIG. 11 is a side view of the locking arrangement shown in FIG. 9 in the used position.

Referring to FIGS. 9 through 11, shown is a further alternate embodiment of the present invention. The chassis of the skate has been removed from FIG. 9 for clarity. In the example, the lock system comprises a cam arrangement. Abutment member 58 includes a wedge-shaped cam body 62 with a plurality of hollow abutments 60 depending integrally therefrom. Cam body 62 includes a pin 64 extending through the forward end thereof for reception in the chassis 14, the arrangement being more clearly shown in FIGS. 10 and 11. This permits pivotal movement of body 62 in a vertical plane relative to wheels 16. The rearward end of body 62 is constantly biassed upwardly by a biassing member 66, an example of which is a spring. The bias maintains the abutment member 58 in the storage position when not in use.

A slidably movable actuator 68 additionally comprises a wedge shaped cam with the thicker portion of the wedge in opposition with that associated with the abutment member 58. This facilitates a downward force opposing the bias of biassing member 66 when actuator 68 is slid into contact with the abutment member 58. Actuator 68 simply fits within the chassis 14 and since the biassing force of abutment 58 must be overcome by forceful injection of actuator 68, there is no inadvertent engagement of abutments 60 between wheels 16 unless a user forcibly inserts actuator 68 into contact with member 58 to depress cam body 62 and thus abutments 60.

In order to retain actuator 68 in a storage position illustrated in FIG. 10, a small slot or raceway 70 in chassis 14, may be provided to receive a guide 72 on actuator 68. For releasable locking in the use position depicted in FIG. 11, actuator 68 may include a groove 74 for receiving projection 76 within chassis 14. Although specific fastening arrangements, e.g. friction screws, guides and pins etc., have been disclosed herein, these are to be construed as exemplary only. Suitable alternative fastening and guide arrangements will be readily apparent to those skilled.

By providing the abutment member and convenient lock system as disclosed herein, it has been found that existing skates may be easily retrofit to include the lock system as discussed herein.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A locking roller skate, comprising:

a roller skate having a plurality of wheels and a chassis for supporting each wheel of said wheels, each wheel of said wheels including a hub projection having at least three sides;

a selectively engageable and releasable locking system for locking said wheels against rotation, said locking system including a slidably mounted abutment member having a plurality of abutments and recesses in alternation, said recesses configured to receive hub projections when said abutment member is moved from a storage position out of contact with said hub projections to a use position where said recesses each receive a respective projection for locking said wheels in a fixed position;

mounting means for slidably mounting said abutment member on said chassis; and frictional securing means connected to said abutment member and said mounting means for securing said abutment member against movement relative to said mounting means when said abutment member is in a storage position.

2. The roller skate as set forth in claim 1, wherein said roller skate comprises a single track roller skate.

3. The roller skate as set forth in claim 1, wherein said abutment member comprises a slidable bar, said slidable bar being mounted in a grooved chassis of said mounting means.

4. The roller skate as set forth in claim 1, wherein said securing means comprises a friction screw.

5. A locking roller skate, comprising:

a roller skate having a plurality of wheels and a chassis for supporting each wheel of said wheels, said wheels including a hub projection having at least three sides;

a selectively engageable and releasable locking system for locking said wheels against rotation, said locking system including a mounting member mounted to said chassis of said roller skate, said mounting member having a groove therein;

an abutment member slidably mounted in said groove of said mounting member for movement relative thereto, said abutment member having a plurality of abutments and recesses in alternation, said recesses configured to receive hub projections when said abutment member is moved from a storage position out of contact with said hub projections to a use position where said recesses each receive a respective projection for locking said wheels in a fixed position; and frictional securing means connected to said abutment member and said mounting means for securing said abutment member against movement relative to said mounting means when said abutment member is in a storage position.

6. The roller skate as set forth in claim 5, wherein said roller skate comprises a single track roller skate.

* * * * *